United States Patent [19]

Cook, Jr.

[11] 3,986,942

[45] *Oct. 19, 1976

[54] ELECTROLYTIC PROCESS AND APPARATUS

[75] Inventor: Edward H. Cook, Jr., Lewiston, N.Y.

[73] Assignee: Hooker Chemicals & Plastics Corporation, Niagara Falls, N.Y.

[ * ] Notice: The portion of the term of this patent subsequent to May 6, 1992, has been disclaimed.

[22] Filed: Feb. 27, 1975

[21] Appl. No.: 553,860

Related U.S. Application Data

[63] Continuation-in-part of Ser. No. 494,110, Aug. 2, 1974, Pat. No. 3,882,002.

[52] U.S. Cl. ..... 204/98; 204/128; 204/242; 204/290 F

[51] Int. Cl.[2] ..... C25B 1/16; C25B 1/26; C25B 11/08; C25B 11/10

[58] Field of Search ..... 204/98, 128, 242, 290 F

[56] References Cited

UNITED STATES PATENTS

| | | | |
|---|---|---|---|
| 3,578,572 | 5/1971 | Lee | 204/95 |
| 3,689,383 | 9/1972 | De Witt | 204/95 |
| 3,732,153 | 5/1973 | Harke et al. | 204/95 |
| 3,882,002 | 5/1975 | Cook | 204/98 |

*Primary Examiner*—R. L. Andrews
*Attorney, Agent, or Firm*—Peter F. Casella; Herbert W. Mylius; William R. Devereaux

[57] ABSTRACT

An electrode, for use in electrolytic processes, comprises a valve metal substrate, such as titanium, a coating thereon of conductive tin cxide, and an outer coating of a noble metal or noble metal oxide. The electrode is particularly adapted to use in a chlorate cell wherein an aqueous alkali metal chloride solution is electrolyzed to produce an alkali metal chlorate.

10 Claims, No Drawings

ELECTROLYTIC PROCESS AND APPARATUS

CROSS-REFERENCE TO RELATED APPLICATIONS

This application is a continuation-in-part of patent application Ser. No. 494,110 to Edward H. Cook, Jr., filed Aug. 2, 1974, U.S. Pat. No. 3,882,002.

BACKGROUND OF THE INVENTION

The present invention relates to improved electrodes particularly adapted for use as anodes in electrochemical process involving the electrolysis of brines.

A variety of materials have been tested and used as anodes in electrolytic cells. In the past, the material most commonly used for this purpose has been graphite. However, the problems associated with the use of graphite anodes are several. The chlorine overvoltage of graphite is relatively high, in comparison for example with the noble metals. Furthermore, in the corrosive media of an electrochemical cell graphite wears readily, resulting in substantial loss of graphite and the ultimate expense of replacement as well as continued maintenance problems resulting from the need for frequent adjustment of spacing between the anode and cathode as the graphite wears away. The use of noble metals and noble metal oxides as anode materials provides substantial advantages over the use of graphite. The electrical conductivity of the noble metals is substantially higher and the chlorine overvoltage substantially lower than that of graphite. In addition, the dimensional stability of the noble metals and noble metal oxides represents a substantial improvement over graphite. However, the use of noble metals as a major material of construction in anodes results in an economic disadvantage due to the excessively high cost of such materials.

In attempts to avoid the use of the expensive noble metals various other anode materials have been proposed for use as coatings over valve metal substrates. In U.S. Pat. No. 3,627,669, it is disclosed that mixtures of tin dioxide and oxides of antimony can be formed as adherent coatings on a valve metal substrate to form an anode useful in electrochemical processes. In the electrolytic production of chlorine, anodes of this type provide the advantage of economy in the elimination of the use of expensive noble metals or noble metal oxides. In addition the tin oxide coating provides an effective protection for the substrate. However, the tin oxide compositions, although useful as an anode material, exhibit a chlorine overvoltage that is substantially higher than that of the noble metals or noble metal oxides. Thus, despite the elimination of expensive noble metals, the cost of chlorine production, in processes using such anodes, is relatively high.

Considerable effort has been expended in recent years in attempts to develop improved anode materials and structures utilizing the advantages of noble metals or noble metal oxides. A great amount of effort has been directed to the development of anodes having a high operative surface area of noble metal or noble metal oxide in comparison with the total quantity of the material employed. This may be done, for example, by employing the noble metal as a thin film or coating over an electrically conductive substrate. However, when it is attempted to minimize the aforementioned economic disadvantage of the noble metals by applying them in the form of very thin films over a metal substrate, it has been found that such very thin films are often porous. The result is an exposure of the substrate to the anode environment, through the pores in the outer layer. In addition, in normal use in an electrolytic cell, a small amount of wear, spalling or flaking off of portions of the noble metal or noble metal oxide is likely to occur, resulting in further exposure of the substrate. Many materials, otherwise suitable for use as a substrate are susceptible to chemical attack and rapid deterioration upon exposure to the anode environment. In an attempt to assure minimum deterioration of the substrate under such circumstances, anode manufacturers commonly utilize a valve metal such as titanium as the substrate material. Upon exposure to the anodic environment, titanium, as well as other valve metals, will form a surface layer of oxide which serves to protect the substrate from further chemical attack. The oxide thus formed, however, is not catalytically active and as a result the operative surface area of the anode is decreased.

Accordingly, it is an object of the present invention to provide improved electrodes for use as anodes in electrolytic processes. It is a further object to provide such anodes having an operative surface of noble metal or noble metal oxide and having improved efficiency and maintenance characteristics.

STATEMENT OF INVENTION

Alkali metal chlorates are produced by the electrolysis of brine solutions, preferably substantially saturated and slightly acidified. It is a usual practice to add about 2 grams per liter of sodium dichromate to reduce the corrosive action of hypochlorous acid which may be liberated by hydrochloric acid that may be present in the electrolysis. The actual products of the electrolysis are alkali metal hydroxide at the cathode and chlorine at the anode. The electrolysis products are allowed to mix forming alkali metal hypochlorites which in turn are oxidized to alkali metal chlorates.

This invention provides a novel electrode, especially suited for use as an anode in either chlor-alkali or alkali metal chlorate cells; the novel electrode comprises a valve metal substrate having a protective coating of conductive tin oxide on the surface thereof and an outer, thin layer of a noble metal or noble metal oxide. Electrodes of this type exhibit a high degree of durability in addition to the relatively low overvoltage characteristics of a noble metal or noble metal oxide, making them well-suited for use as anodes in the electrolytic production of chlorine.

Among the advantages of such construction is the protection afforded the metal substrate by the coating of conductive tin oxide. The preferred substrate materials of the anodes of the invention are the valve metals, such as titanium, tantalum, niobium or zirconium, especially titanium. However, where suitably thick intermediate layers of tin oxide are employed, other more conductive metals may be considered for use as substrates. The tin oxide coating, which may range in coating weight from about 0.1 grams per square meter to 100 grams per square meter or more, depending on the degree of protection desired, prevents contact of the substrate and the electrolyte, thus preventing or minimizing corrosion or surface oxidation and the attendant deterioration or passivation of the substrate. At the same time, the outer layer provides the advantageous catalytic properties of the noble metals or noble metal oxides. In addition, the protective layer of conductive tin oxide permits the use of a relatively thin layer of the noble metal or noble metal oxide and a consequent savings resulting from a minimal use of the precious metal. Typically, the layer of noble metal or noble metal oxide will have a coating weight in the range of about 0.1 grams per square meter to about 20 grams per square meter or higher and preferably about 3 to 10 grams per square meter in thickness. The disadvantage of pores or pinholes in the noble metal layer common in extremely thin layers is obviated by the presence of the intermediate layer of conductive tin oxide. Pores or pinholes in the noble metal layer, or wearing away of that outer layer over long periods of use result in the gradual exposure of the tin oxide layer. The intermediate layer of tin oxide will continue to provide a catalytically active surface in those exposed areas. The catalytic characteristics of tin oxide, although not as high as the noble metals or noble metal oxides, is quite substantially higher than the valve metal oxide. Thus, the overall deterioration of the catalytic properties of the anode is more gradual and maintenance problems are accordingly lessened.

In addition, it has been found that the intermediate layer of tin oxide provides an increase in surface area of the anode with a consequent improvement in overvoltage. It has further been found that the adhesion of the noble metal or noble metal oxide to the substrate is increased by the presence of the intermediate layer of tin oxide and the problem of spalling of the surface layer is thereby reduced.

DESCRIPTION OF THE PREFERRED EMBODIMENTS

The valve metal substrate which forms the inner or base component of the electrode is an electroconductive metal having sufficient mechanical strength to serve as a support for the coating and having a high degree of chemical resistivity, especially to the anodic environment of electrolytic cells. Typical valve metals include, for example, Ti, Ta, Nb, Zr, and alloys thereof. The valve metals are well known for their tendency to form an inert oxide film upon exposure to an anodic environment. The preferred valve metal, based on cost and availability as well as electrical and chemical properties is titanium. The conductivity of the substrate may be improved, if desired, by providing a central core of a highly conductive metal such as copper. In such an arrangement, the core must be electrically connected to and completely protected by the valve metal substrate.

Tin oxide can be readily formed as an adherent coating on a valve metal substrate, in a manner described hereinafter, to provide a protective, electrically conductive layer which is especially resistant to chemical attack in anodic environments. Pure tin oxide however has a relatively high electrical resistivity in comparison to metals and exhibits undesirable change in electrical resistivity as a function of temperature. It is well known that the electrical stability of tin oxide coatings may be substantially improved and the electrical resistivity lowered through the introduction of a minor proportion of a suitable inorganic material (commonly referred to as a "dopant"). A variety of materials, especially various metal oxides and other metal compounds and mixtures thereof, have been disclosed in the prior art as suitable dopants for stabilizing and lowering the electrical resistivity of tin oxide compositions. Among the materials shown in the prior art to be useful as dopants in conductive tin oxide compositions and which may be employed in the tin oxide coating compositions of the anodes of this invention are included, for example, fluorine compounds, especially the metal salts of fluorine, such as sodium fluoride, potassium fluoride, lithium fluoride, beryllium fluoride, aluminum fluoride, lead fluoride, chromium fluoride, calcium fluoride, and other metal fluorides; hydrazine, phenylhydrazine, phosphorus compounds such as phosphorus chloride, phosphorus oxychloride, ammonium phosphate, organic phosphorus esters such as tricresyl phosphate; as well as compounds of tellurium, tungsten, antimony, molybdenum, arsenic, and others and mixtures thereof. The conductive tin oxide coatings of this invention comprise tin oxide, preferably containing a minor amount of a suitable dopant. The preferred dopant is an antimony compound which may be added to the tin oxide coating composition either as an oxide or as a compound such as $SbCl_3$ which may form the oxide when heated in an oxidizing atmosphere. Although the exact form of the antimony in the final coating is not certain, it is assumed to be present as $Sb_2O_3$ and data and proportions in this specification and the appended claims are based on that assumption. The preferred compositions of this invention comprise mixtures of tin oxide and a minor amount of antimony oxide, the latter being present preferably in an amount of between about 0.1 and 20 weight percent (calculated on the basis of total weight of $SnO_2$ and $Sb_2O_3$).

Conductive tin oxide coatings may be adherently formed on the surface of the valve metal substrate by various methods known in the art. Typically such coatings may be formed by first chemically cleaning the substrate, for example, by degreasing and etching the surface in a suitable acid, e.g., oxalic acid, then applying a solution of appropriate thermally decomposable salts, drying and heating in an oxidizing atmosphere. The salts thay may be employed include, in general, any thermally decomposable inorganic or organic salt or ester of tin and dopant, e.g., antimony, including for example their chlorides, alkoxides, alkoxy halides, resinates, amines and the like. Typical salts include for example, stannic chloride, dibutyltin dichloride, tin tetraethoxide, antimony trichloride, antimony pentachloride and the like. Suitable solvents include for example, ethyl alcohol, propyl alcohol, butyl alcohol, pentyl alcohol, amyl alcohol, toluene, benzene and other organic solvents as well as water.

The solution of thermally decomposable salts, containing for example, a salt of tin and a salt of antimony, or other dopant, in the desired proportions, may be applied to the cleaned surface of the valve metal substrate by painting, brushing, dipping, rolling, spraying or other method. The coating is then dried by heating for example at about 100° to 200°C for several minutes to evaporate the solvent, and then heating at a higher temperature, e.g., 250° to 800°C in oxidizing atmosphere to convert the tin and antimony compounds to their respective oxides. The procedure may be repeated as many times as necessary to achieve a desired coating weight or thickness. The final coating weight of this conductive tin oxide coating may vary considerably, but is preferably in the range of about 3 to about 30 grams per square meter.

Optionally, a small amount, such as up to 3 percent by weight of a chlorine discharge catalyst such as at least one of the difluorides of manganese, iron, cobalt or nickel may be included in the tin oxide coating to lower the overpotential required for chlorine gas liberation in a chlor-alkali cell. The chlorine discharge catalyst may be added to the tin oxide coating by suspending a fine particulate preformed sinter of tin dioxide and the catalyst in the solution of thermally decomposable salts. Such chlorine discharge catalysts in the tin oxide coating are not essential to the anodes of this invention but may be employed if desired in a known manner such as disclosed in U.S. Pat. No. 3,627,669.

The outer coating of the anode comprises a noble metal or noble metal oxide such as platinum, iridium, rhodium, palladium ruthenium or asmium or mixtures or alloys of these metals or the oxides or mixtures of the oxides of these metals. An outer coating of a noble metal may be applied by known methods such as electroplating, chemical deposition from a platinum coating solution, spraying, or other methods.

Preferably, the outer coating of the anode comprises a noble metal oxide. Noble metal oxide coating may be applied by first depositing the noble metal in the metallic state and then oxidizing the noble metal coating, for example, by galvanic oxidation or chemical oxidation by means of an oxidant such as an oxidizing salt melt, or by heating to an elevated temperature, e.g., 300° to 600°C or higher in an oxidizing atmosphere such as air or oxygen, at atmospheric or superatmospheric pressures to convert the noble metal coating to a coating of the corresponding noble metal oxide. Other suitable methods include, for example, electrophoretic deposition of the noble metal oxide; or application of a dispersion of the noble metal oxide in a carrier, such as alcohol, by spraying, brushing, rolling, dipping, painting, or other method on to the tin oxide surface followed by heating at an elevated temperature to evaporate the carrier and sinter the oxide coating. A preferred method for the formation of the noble metal oxide coating involves coating the conductive tin oxide surface with a solution of a noble metal compound, evaporating the solvent and converting the coating of noble metal compound to the oxide by chemical or electrochemical reaction. For example, the conductive tin oxide surface may be coated with a solution of a thermally decomposable salt of a noble metal, such as a solution of a noble metal halide in an alcohol, evaporation of the solvent, followed by heating at an elevated temperature such as between about 300° and 800°C in an oxidizing atmosphere such as air or oxygen for a period of time sufficient to convert the noble metal halide to a noble metal oxide. The procedure for formation of a noble metal or noble metal oxide coating may be repeated as often as necessary to achieve the desired thickness. The foregoing and other methods for the preparation of coatings of noble metals and noble metal oxides on substrates and useful as electrodes are well known in the art and may be found for example in U.S. Pat. No. 3,711,385.

The following specific examples will serve to further illustrate this invention. In the examples and elsewhere in this specification and claims, all temperatures are in degrees Celsius and all parts and percentages are by weight unless otherwise indicated.

EXAMPLE I

IA. Preparation of Conductive Tin Oxide Coating

A strip of titanium plate was prepared by immersion in hot oxalic acid for several hours to etch the surface, then washed and dried. The titanium was then coated with a composition of tin oxide doped with antimony oxide, following the procedure of Example 4 of U.S. Pat. No. 3,627,669, in the following manner:

Tin dioxide was prepared by dissolving metallic tin (84 parts) in concentrated nitric acid and heating until tin dioxide was precipitated. Antimony trioxide (18 parts) was boiled in concentrated nitric acid until evolution of nitrogen oxides ceased, then thoroughly mixed with the precipitated tin oxide. The mixture was further treated with hot nitric acid, then washed free of acid and air dried at about 200°C. About 3 percent by weight of manganese difluoride was added and mixed with the dried mixed oxides. The mixture was then compressed into pellets, heated in air at about 800°C for 24 hours, then crushed and reduced to a particle size of less than 60 microns. The crushed mixed oxide composition was again pelletized and heated as before and then crushed and ball-milled to a particle size of less than 5 microns.

An antimony trichloride-alkoxy-tin solution was prepared by boiling at reflux conditions for 24 hours a mixture of 15 parts of stannic chloride and 55 parts of n-amyl alcohol then dissolving therein 2.13 parts of antimony trichoride.

A suspension of 0.17 parts of the mixed oxide composition in 3.6 parts of the antimony trichloride-alkoxy-tin solution was prepared and painted on to the cleaned titanium surface and the coating was oven-dried at 150°C. Two additional coats of the same composition were similarly applied and dried after which the coated strip was heated in air at 450°C for about 15 minutes to convert the coating substantially to oxides of tin and antimony with manganese fluoride. The coating operation, including the final heating at 450°C was repeated three times to increase the thickness of the coating.

The theoretical composition of the conductive coating thus prepared, was 85.6 percent $SnO_2$; 13.7 percent antimony oxides (calculated as $Sb_2O_3$); and 0.7 percent $MnF_2$. The coating weight of the finished coating was 21.2 grams per square meter.

IB. Preparation of $RuO_2$ Coating

The conductive tin oxide coated titanium was further coated in the following manner:

A solution of 1 gram of ruthenium trichloride in 0.4 cubic centimeters of 36 percent hydrochloric acid and 6.2 cubic centimeters of butyl alcohol was brushed several times on to the tin oxide surface and then allowed to dry in air at room temperature. After drying, the samples were heated in air at 560°C for 25 minutes to decompose the $RuCl_3$ and form $RuO_2$. An additional coating of $RuCl_3$ was similarly applied, dried and thermally treated, to yield a final coating of $RuO_2$ having a coating weight of about 6.0 grams of ruthenium per square meter.

In the foregoing Example, a minor proportion of a chlorine discharge agent, manganese difluoride was incorporated in the conductive tin oxide coating. An anode may also be prepared in accordance with this invention, following the procedure of Example I except that no chlorine discharge agent is added.

EXAMPLE II

Chlorine Cell Test

The anode, prepared as described in Example IB, was installed and tested as an anode in a chlorine cell having a steel cathode separated from the anode by a cationic membrane. The anode compartment was supplied with preheated brine having a composition of about 310 g/l NaCl and pH of about 4.5. The anolyte was maintained at about 95°C. The test was conducted at a constant current density of 310 ma/cm² (2.0 ASI). The anode exhibited a potential of 1.19 volts (v. a saturated calomel electrode) which potential remained stable during an extended test period.

For purposes of comparison, a commercially available anode composed of a titanium substrate leaving a coating of ruthenium oxide directly on the surface thereof was installed and tested under identical conditions. The anode exhibited a potential of 1.26 volts (v. a saturated calomel electrode). Thus, it will be seen that an improvement in overvoltage is achieved in anodes, such as the anode of Example IB, where the outer coating of noble metal oxide is deposited on the surface of a layer of conductive tin oxide rather than directly on the surface of the valve metal substrate.

EXAMPLE III

An anode prepared in accordance with Example IB, that is, an anode consisting of a titanium substrate, an outer coating of ruthenium oxide, and an intermediate layer of conductive tin oxide, was tested in comparison with an anode prepared in accordance with Example IA, that is, an anode consisting of a titanium substrate and a coating of conductive tin oxide. The anodes were installed and tested under identical conditions in a chlorine cell having a steel cathode, separated from the anode by a cationic membrane. The anode compartment was supplied with preheated brine having a concentration of about 310 grams of NaCl per liter and a pH of about 4.5. The anolyte was maintained at about 95°C and the test was conducted at a constant current density of 310 ma/cm² (2.0 ASI). The anode of Example IB exhibited an initial potential of about 1.20 volts (v. a saturated calomel electrode), the potential remaining essentially constant over a 127 hour test period. Under identical test conditions, the anode of Example IA exhibited an initial potential of about 1.52 volts (v. a saturated calomel electrode), the potential rising to 1.76 volts over a 128 hour test period.

EXAMPLE IV

A. A sample of titanium mesh was coated with a layer of conductive tin oxide following the procedure of Example IA.

B. A sample of titanium mesh coated with conductive tin oxide as described in Example IVA was further coated with an outer layer of ruthenium dioxide following the procedure of Example IB.

The mesh anodes, prepared as described in A and B above, were installed and tested as anodes in chlorine cells wherein the electrode gap between the anode and a steel cathode was ⅛ inch, and the anode and cathode were separated by a cationic membrane. The cells were operated with anolyte concentrations ranging from 250 to 310 grams NaCl/liter at a pH of 4.5, and temperatures ranging from 80° to 90°C. The tests were conducted at a constant current density of 310 ma/cm² (2.0 ASI). The anode of Example IVB exhibited an initial potential of about 1.32 v and remained substantially stable over a 60 day period of operation whereas the anode of Example IVA exhibited an initial potential of about 1.50 volts, and the potential rose gradually to about 1.90 on the 50th day of operation, then rose very rapidly on the 52nd day and achieved complete passivation on the 55th day.

EXAMPLE V

Anode plates (5 × 6 inches) prepared in accordance with the procedures of Examples IA and IB, were installed and tested in a chlorate cell which employs two anode plates surrounded by a mild steel cathode shell. The gap between the anode and cathode was ⅛ inch. The cell was operated at a current density of 4.0 ASI and maintained at about 70°C. The electrolyte composition ranged from 400 to 550 grams of $NaClO_3$ and 120 to 150 grams NaCl and 1.0 to 1.5 grams sodium dichromate per liter and a pH of about 6.7.

The anode of Example IA, having an outer coating of conductive tin oxide, exhibited an initial potential of 4.0 volts. The potential rose gradually to 5.4 volts during the first 40 hours of operation and the anode failed completely in less than 2 days of operation. Under identical conditions the anode of Example IB exhibited a lower initial potential (3.50 volts) and excellent stability, rising to about 4.05 volts over an operating time of 91 days. In a further run the anode of Example IB after 160 days operation under identical conditions exhibited a rather stabilized voltage of approximately 3.82 volts and operated at a 92–94 percent current efficiency.

The foregoing specification is intended to illustrate the invention with certain preferred embodiments, but it is understood that the details disclosed herein can be modified without departing from the spirit and scope of the invention.

I claim:

1. In a method of electrolyzing aqueous alkali metal chloride solutions wherein chlorine is liberated at the anode, an alkali metal hydroxide is formed at the cathode and the electrolysis products are mixed to form alkali metal chlorates, the improvement which comprises using as said anode, a composite structure comprising a valve metal substrate, a coating of conductive tin oxide on the surface thereof, and an outer coating, on the surface of the conductive tin oxide, of at least one of a noble metal or noble metal oxide.

2. A method according to claim 1 wherein the anode comprises a titanium substrate, a coating thereon of conductive tin oxide, and an outer coating or ruthenium oxide.

3. A method according to claim 1 wherein the conductive tin oxide comprises a mixture of tin oxide and between about 0.1 and 20 percent by weight of antimony oxide, based on the total weight of the mixture when calculated as $SnO_2$ and $Sb_2O_3$.

4. A method according to claim 1 wherein the alkali metal chloride is sodium chloride.

5. An electrolytic cell useful for producing alkali metal chlorates, said cell having a steel cathode and an anode, comprising a valve metal substrate, a coating thereon of conductive tin oxide, and an outer coating of at least one of a noble metal or noble metal oxide.

6. An electrolytic cell according to claim 5 wherein the anode substrate is titanium.

7. An electrolytic cell according to claim 5 wherein the conductive tin oxide layer in the anode comprises a mixture of tin dioxide and a minor amount of antimony oxide.

8. An electrolytic cell according to claim 5 wherein the outer coating of the anode is a noble metal oxide.

9. An electrolytic cell according to claim 5 wherein the outer coating of the anode is ruthenium oxide.

10. An electrolytic cell according to claim 5 wherein the conductive tin oxide layer in the anode comprises a mixture of tin oxide and between about 0.1 and about 20 percent by weight of antimony oxide, based on the total weight of said mixture when calculated as $SnO_2$ and $Sb_2O_3$.

* * * * *